US008173218B2

(12) United States Patent
Mase et al.

(10) Patent No.: US 8,173,218 B2
(45) Date of Patent: May 8, 2012

(54) METHOD OF SPRAYING A TURBINE ENGINE COMPONENT

(75) Inventors: Frank W. Mase, Kennebunk, ME (US); Christopher W Strock, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 434 days.

(21) Appl. No.: 11/877,849

(22) Filed: Oct. 24, 2007

(65) Prior Publication Data

US 2009/0110831 A1 Apr. 30, 2009

(51) Int. Cl.
*B05D 1/32* (2006.01)

(52) U.S. Cl. ..... 427/282; 118/505

(58) Field of Classification Search ..... 427/282, 427/140, 142, 448; 118/505; 29/889.1, 889.71, 29/889.72, 889.721, 889.722
See application file for complete search history.

(56) References Cited

U.S. PATENT DOCUMENTS

| | | | | |
|---|---|---|---|---|
| 3,565,664 | A * | 2/1971 | Al | 427/185 |
| 4,743,462 | A * | 5/1988 | Radzavich et al. | 427/448 |
| 4,879,158 | A * | 11/1989 | Horiki et al. | 428/159 |
| 5,508,097 | A | 4/1996 | Hauser et al. | |
| 5,565,035 | A | 10/1996 | Sylvestro | |
| 5,645,399 | A * | 7/1997 | Angus | 415/178 |
| 5,691,018 | A | 11/1997 | Kelley et al. | |
| 5,786,028 | A | 7/1998 | Cantwell | |
| 5,813,118 | A | 9/1998 | Roedl et al. | |
| 5,916,638 | A * | 6/1999 | Zajchowski et al. | 427/448 |
| 5,998,755 | A | 12/1999 | Zajchowski et al. | |
| 6,037,004 | A | 3/2000 | Zajchowski et al. | |
| 6,296,705 | B1 | 10/2001 | Ireland et al. | |
| 6,403,157 | B2 | 6/2002 | Ireland et al. | |
| 6,706,323 | B2 | 3/2004 | Wheat et al. | |
| 6,875,476 | B2 | 4/2005 | Hawtin et al. | |
| 6,884,476 | B2 | 4/2005 | Pfaendtner et al. | |
| 7,122,224 | B2 * | 10/2006 | Das et al. | 427/282 |
| 7,147,899 | B2 | 12/2006 | Fernihough et al. | |
| 7,192,622 | B2 | 3/2007 | Fernihough et al. | |
| 2005/0084657 | A1 | 4/2005 | Ohara | |
| 2007/0205207 | A1 * | 9/2007 | Dornbach | 220/803 |

FOREIGN PATENT DOCUMENTS

| | | |
|---|---|---|
| DE | 102009014098 | 9/2010 |
| EP | 0925844 | 6/1999 |
| EP | 1537950 | 6/2005 |
| EP | 1676642 | 7/2006 |

OTHER PUBLICATIONS

European Search Report, dated Dec. 29, 2011, EP Application No. 08253459.5.

* cited by examiner

*Primary Examiner* — Katherine A Bareford
*Assistant Examiner* — Tabatha Penny
(74) *Attorney, Agent, or Firm* — Carlson Gaskey & Olds, P.C.

(57) ABSTRACT

A method of spraying a component involves disposing a component near a spray coating device. The component has a first mating feature that is formed as part of the component. A first mask is disposed over a portion of the component and has a second mating feature. The first mating feature is resiliently connected to the second mating feature. The component is then sprayed.

21 Claims, 3 Drawing Sheets

METHOD OF SPRAYING A TURBINE ENGINE COMPONENT

BACKGROUND OF THE INVENTION

This invention relates to a method of spray coating a component, such as a case for a turbine engine.

As part of the manufacture, repair and maintenance of a turbine engine, it may become necessary to coat a turbine engine component. This process may involve masking portions of the turbine engine component to prevent them from being coated by a spray coating device, such as a thermal spray torch. In addition, masking may protect against grit blast used to prepare the surface of a turbine engine component for coating.

Generally, a metal mask may be used to protect the turbine engine component from the coating. The mask is attached to the turbine engine component by another device. Following coating, the metal mask is removed and then cleaned by chemicals, mechanical techniques or water pressure. This masking process is very expensive because of material and labor costs associated with the mask and its cleaning.

Another alternative is to use a tape mask. Portions of the turbine engine component are manually covered with tape. This process, however, is labor intensive.

A need therefore exists for a technique for protecting a turbine engine component from a spray, such as from a thermal spray torch, that is easy to install and is inexpensive.

SUMMARY OF THE INVENTION

The invention comprises a method of spraying a component. A turbine engine component, such as a case, is disposed near a spray coating device, such as a thermal spray torch. The turbine engine component has a first mating feature formed as part of the turbine engine component. A mask is disposed over a portion of the turbine engine component. The mask has a second mating feature. The mask is connected to the turbine engine component by resiliently connecting the first mating feature to the second mating feature. The turbine engine component is then sprayed.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
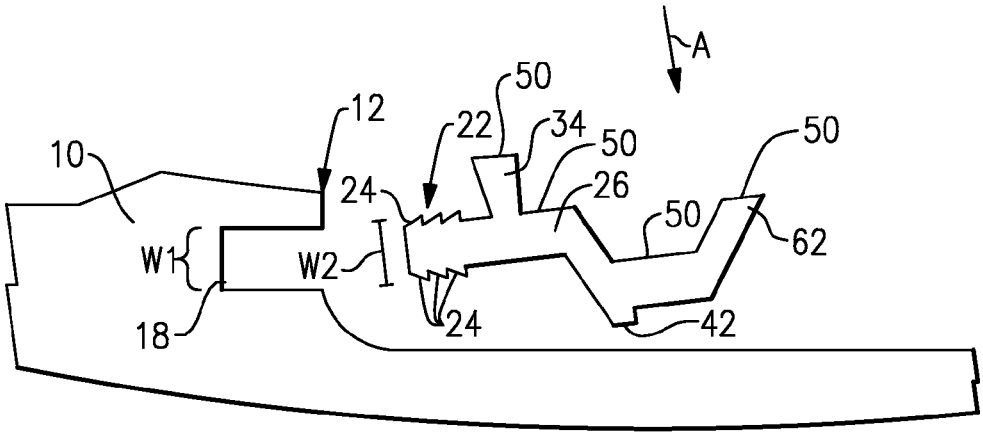
FIG. 1 illustrates a cross sectional view of a turbine engine component and a mask prior to the resilient connection of the mask to the turbine engine component.

FIG. 1 illustrates a cross sectional view of the inventive mask, first mask 26, and turbine engine component 10, such as a case for a turbine engine. Turbine engine component 10 has first mating feature 18, which is formed integrally with turbine engine component 10. Here, first mating feature 18 is a slot for receiving a turbine vane or other airfoil component. First mating feature 18 has width $W_1$. First mating feature 18 may be an opening as well.

Figure 2:
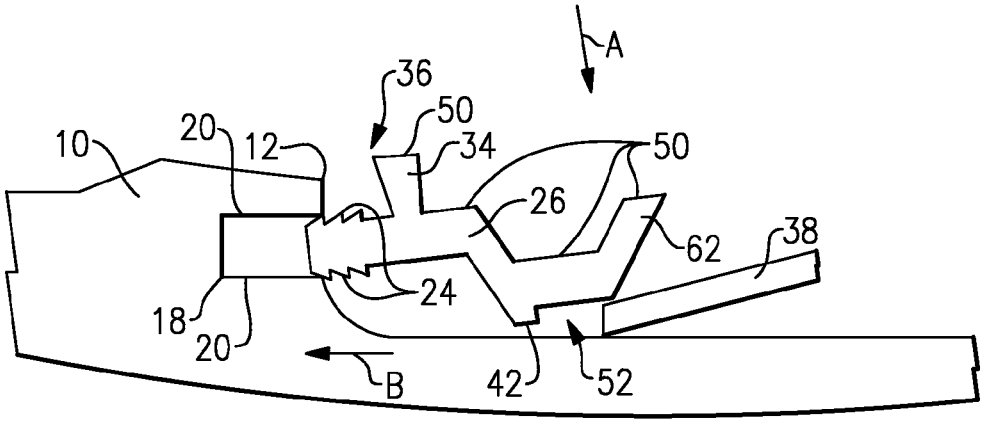
FIG. 2 illustrates the resilient connection of the mask of FIG. 1 to the turbine engine component.

First mask 26 is made of a resilient material, such as rubber, and has lands 50 that serve to block the application of coating on turbine engine 10, say in the direction of arrow A. First mask 26 has second mating feature 22, here a barbed protrusion with ribs 24 having outer width $W_2$. Width $W_2$ is slightly greater than width $W_1$ such that when first mask 26 is inserted into the direction of arrow B, as shown in FIG. 2, into first mating feature 18, ribs 24 compress inwardly as they are pressed into first mating feature 18. Because first mask 26 and, in particular, second mating feature 22 are made of resilient material, second mating feature 22 will resiliently connect with first mating feature 18 as ribs 24 rebound outwardly against walls 20 of first mating feature 18. First mask 26 is thereby held in place to first mating feature 18 of turbine engine component 10 by second mating feature 22. In this way, first mask 26 may be quickly and easily installed into an existing feature of the turbine engine component 10. No additional connection device is required.

Figure 3:
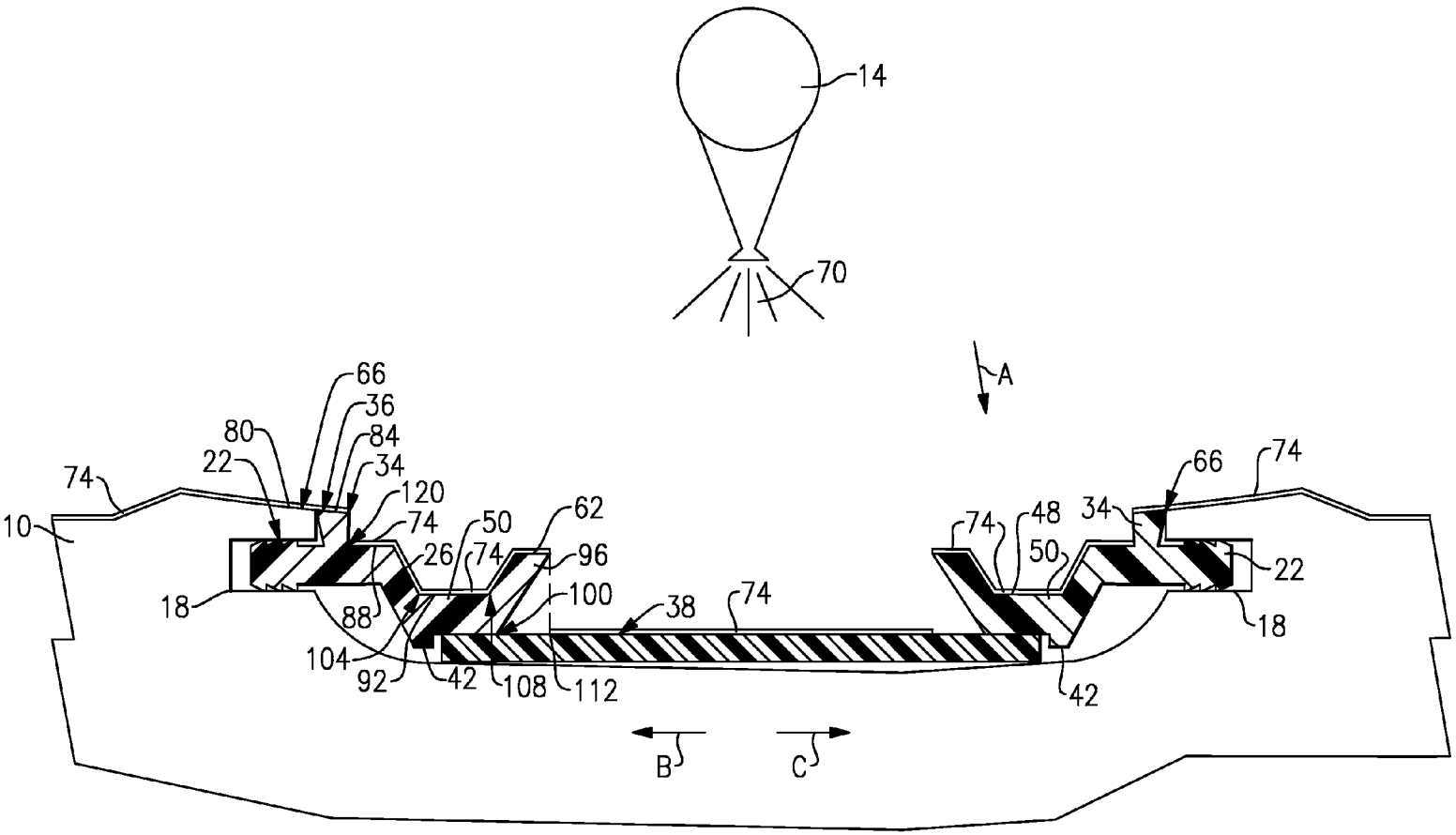
FIG. 3 illustrates a side view of the turbine engine component with mask in place sprayed by a thermal spray coating device.

With reference to FIG. 1, first mask 26 has first flange 34, second flange 62 and support 42. First flange 34 is also resilient and compressible because it is likewise made of rubber or other resilient material. When first mask 26 is seated in first mating feature 18 as shown in FIG. 3, corner 34 of first flange 36 will compress against edge 12 of turbine engine component 10 to thereby form seal 66 against coating in the direction of arrow A (as shown in FIG. 3). Coating is thereby prevented from passing into first mating feature 18 as well as the surrounding area. Thus, in one insertion of first mask 26 in the direction of arrow B, first mask 26 is both connected to turbine engine component 10 and seal 66 is formed.

In addition, first mask 26 may be used in conjunction with another mask, say second mask 38, which may be made of inexpensive metal, plastic or rubber sheet stock. As shown in FIG. 2, first mask 26 is inserted in the direction of arrow B and second mask 38 is then disposed in the same direction under first mask 26 at location 52. With reference to FIG. 2, first mask 26 has support 42 that secures second mask 38 from further movement in the direction of arrow B. Furthermore, support 42 also precludes or blocks movement of overspray from spray coating device 14, such as from a thermal spray torch, that may pass in the direction of arrow B along second mask 38.

With reference to FIG. 3, third mask 48, having the same features as first mask 26 as shown, is disposed over second mask 38 and is also resiliently connected to turbine engine component 10 in the same manner as first mask 26 into first mating feature 18. Third mask 48 has support 42 to prevent movement of second mask 38 in the direction of arrow C. In this way, second mask 38 may be quickly secured to turbine engine component 10.

Figure 4:
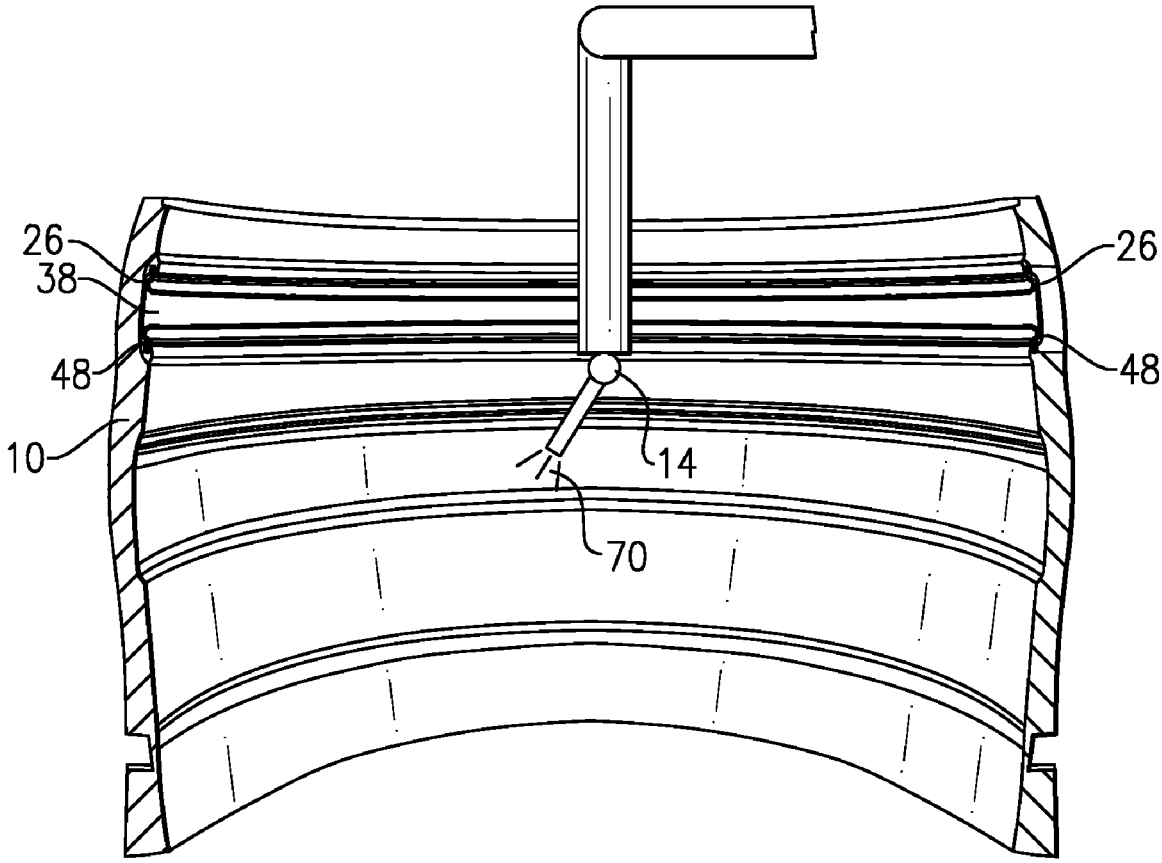
FIG. 4 illustrates a plan view of the turbine engine component, mask and thermal spray coating device of FIGS. 1 through 3.

Referring back to FIG. 3, once first mask 26, second mask 38 and third mask 48 are secured to turbine engine component 10, spray coating device 14 expels spray 70 in the direction of arrow A. Turbine engine component 10 is thereby protected against coating in the areas covered by first mask 26, second mask 38 and third mask 48. As shown in FIG. 4, large portions of turbine engine component 10 may be protected from coating sprayer 14 by quickly inserting first mask 26, second mask 38 and third mask 48.

Moreover, as shown in FIG. 3, surfaces 84, 88, 92 and 96 are stepped in the direction of arrow A relative to first surface 80. Surface 88 is displaced from surface 80 while surface 92 is displaced from surface 88. Surface 96 is also displaced from its neighboring surface, surface 92, as well as surface 100 of second mask 38. Consequently, when spray coating device 14 sprays in the direction of arrow A, coating 74 is formed at different levels creating break lines for the coating at locations 120, 104, 108 and 112. Because coating 74 is broken at these locations, coating 74 may be easily removed by peeling along the break lines. In this way, excess coating may be quickly removed from first mask 26, second mask 38 and third mask 48 as well as ultimately from turbine engine component 10.

The foregoing description shall be interpreted as illustrative and not in any limiting sense. A worker of ordinary skill in the art would recognize that certain modifications would come within the scope of this invention. For that reason, the follow claims should be studied to determine the true scope and content of this invention.

We claim:

1. A method of spraying a component, comprising the steps of:

a) disposing a turbine engine component proximate a spray coating device, the component having a first mating feature formed as part of the component;

b) disposing a first mask against an outer surface of the component, the first mask having a second mating feature formed as part of the first mask;

c) resiliently connecting the first mating feature to the second mating feature;

d) spraying the component; and e) blocking spray to a portion of the outer surface with the first mask, the blocked spray forming a coating that is removable from the first mask after the spraying, wherein the second mating feature is a barbed protrusion and the first mask further includes a first flange, a second flange, and a support all formed as part of the first mask, wherein at least the first flange and the second flange block spray to the portion of the outer surface.

2. The method of claim 1, including the step of:

f) compressing a portion of the first mask against the outer surface of the component to form a seal.

3. The method of claim 1, including the step of:

f) disposing a second mask between the first mask and the component so that the second mask is held against an area of the component by the first mask to secure the second mask, the second mask extending further from the first mating feature than the first mask.

4. The method of claim 3 wherein the first mask has a support to retain the second mask, the support formed as a portion of the first mask.

5. The method of claim 4 wherein the support is configured to block a spray from the spray coating device.

6. The method of claim 1 wherein the first mating feature forms an opening and the second mating feature forms a protrusion disposable in the opening.

7. The method of claim 6 wherein the protrusion has a compressible rib for securing the protrusion within the opening, the compressible rib compressed when secured within the opening and expanded when not secured within the opening.

8. The method of claim 7 wherein resiliently connecting comprises inserting the protrusion into the opening, the compressible rib received entirely within the opening.

9. The method of claim 1 wherein the first mask has a first surface and has a second surface, the second surface spaced from the first surface along a direction of spray from the sprayer such that a break is created in the spray between the first surface and the second surface, the first surface and the second surface both facing the sprayer during the spraying.

10. The method of claim 1, wherein the first mask comprises a rubber mask.

11. The method of claim 1, wherein the second mating feature is a unitized portion of the first mask.

12. The method of claim 1, including compressing ribs on one of the first mating feature or the second mating feature during the connecting.

13. The method of claim 1, including maintaining an original shape of the first mask during the spraying.

14. A method of coating a turbine engine component, comprising the steps of:

a) disposing a turbine engine component proximate a spray coating device, the turbine engine component having a first mating feature formed as part of the turbine engine component;

b) disposing at least a portion of a first mask over a portion of the turbine engine component, the mask having another portion having a second mating feature that is directly connected to the portion of the first mask disposed over the turbine engine component;

c) resiliently connecting the first mating feature to the second mating feature;

d) compressing a portion of the first mask against an exterior surface of the turbine engine component to form a seal with the exterior surface;

e) coating the turbine engine component; and f) disposing a second mask between the first mask and the turbine engine component so that the second mask is secured by the first mask against the turbine engine component wherein the first feature is a slot for receiving an airfoil component of the turbine engine component.

15. The method of claim 14 wherein the first mating feature forms a hole and the second mating feature forms a protrusion disposable in the hole.

16. The method of claim 15 including a third mask resiliently secured to the turbine engine component and securing the second mask against the turbine engine component.

17. The method of claim 15 wherein the first mask has a block that supports the second mask.

18. The method of claim 17 wherein the block blocks a spray from the spray coating device.

19. The method of claim 15 wherein the protrusion has a compressible rib for securing the protrusion within the hole, the compressible rib received entirely within the hole.

20. The method of claim 15 wherein the first mask has a first surface and has a second surface, the second surface spaced from the first surface along a direction of spray from the spray coating device such that break is created in the coating between the first surface and the second surface when the turbine engine component is sprayed, the first surface and the second surface both facing the sprayer during the spraying.

21. The method of claim 15, wherein the exterior surface comprises a surface facing outwardly away from the component.

* * * * *